US005372975A

United States Patent [19]

Ishikawa et al.

[11] Patent Number: 5,372,975

[45] Date of Patent: Dec. 13, 1994

[54] SILVER HALIDE PHOTOGRAPHIC EMULSION

[75] Inventors: Sadayasu Ishikawa; Hiroshi Takada; Toshiya Kondo, all of Hino, Japan

[73] Assignee: Konica Corporation, Japan

[21] Appl. No.: 5,586

[22] Filed: Jan. 19, 1993

[30] Foreign Application Priority Data

Jan. 31, 1992 [JP] Japan ..... 4-015845

[51] Int. Cl.[5] ..... G03C 1/005; G03C 1/015; G03C 1/07

[52] U.S. Cl. ..... 430/569; 430/567

[58] Field of Search ..... 430/567, 569

[56] References Cited

U.S. PATENT DOCUMENTS

| | | | |
|---|---|---|---|
| 3,977,879 | 8/1976 | Bigelow . | |
| 4,678,745 | 7/1987 | Yamada et al. | 430/569 |
| 4,713,323 | 12/1987 | Maskasky | 430/569 |
| 4,789,618 | 12/1988 | Inoue et al. | 430/569 |
| 5,030,552 | 7/1991 | Iwasaki et al. | 430/567 |
| 5,244,781 | 9/1993 | Takada | 430/567 |

FOREIGN PATENT DOCUMENTS 369491 5/1990 European Pat. Off. .

OTHER PUBLICATIONS

Patent Abstracts of Japan, vol. 14, No. 551 (P-1139); Dec. 7, 1990 JPA-2-235,043; Sep. 18, 1990.

Chemical Abstracts, vol. 116, No. 4; Jan. 27, 1992, Abstract #31138U Lebedeu, et al; Mechanism . . . levels, p. 690.

*Primary Examiner*—Janet C. Baxter
*Assistant Examiner*—Mark F. Huff
*Attorney, Agent, or Firm*—Jordan B. Bierman

[57] ABSTRACT

Disclosed is a silver halide photographic emulsion which comprises a dispersion medium and silver halide grains, wherein said silver halide grains are prepared by a process comprising the steps of:

(a) preparing a dispersion medium, wherein said dispersion medium comprises a gelatin solution, (b) introducing an oxidizer into said dispersion medium; and (c) introducing silver halide seed grains.

The silver halide emulsion provides a sliver halide photographic light-sensitive material high in sensitivity and excellent in pressure resistance.

12 Claims, No Drawings

SILVER HALIDE PHOTOGRAPHIC EMULSION

FIELD OF THE INVENTION

This invention relates to a silver halide photographic emulsion applicable to silver halide photographic light sensitive materials and particularly to a silver halide photographic emulsion applicable to silver halide photographic light sensitive materials improved on sensitivity and pressure resistance.

BACKGROUND OF THE INVENTION

In recent years, picture-taking equipments such as cameras have been popularized more and more and picture-taking opportunities in which silver halide photographic light sensitive materials are used have also been increased. In keeping with the above-mentioned circumstances, the silver halide photographic light sensitive materials have been strongly required to make their sensitivities and image qualities higher.

In addition to the above, there has been the tendency that more complicated and various characteristic improvements have been requested for the silver halide photographic light sensitive materials.

Particularly from the viewpoint for stabilizing the photographic characteristics, it has been demanded to improve the resistance to various pressures accidentally or inevitably applied to a silver halide photographic light sensitive material subject to photography, development and so forth.

As the means for improving the pressure resistance, there have so far been the means in which an iridium salt or a thallium salt is added to silver halide grains when the grains are formed. These means have been described in, for example, U.S. Pat. No. 2,628,167 and Japanese Patent Publication Open to Public Inspection (hereinafter referred to as JP OPI Publication) Nos. 50-116025/1975 and 51-107129/1976. However, these means have had such a problem that the sensitivity is lowered.

In addition to the above, JP OPI Publication No. 1-183644/1989 discloses a means of making use of a silver halide emulsion containing tabular-shaped silver halide grains having a silver halide phase containing silver iodide of 3 mol % or more and having a completely uniform silver iodide distribution of the silver halide containing the above-mentioned silver iodide. However this means has not been quite satisfactory to meet the requirements for further improving the pressure resistance.

Further, there have been the other known techniques in which the physical properties of a silver halide grain dispersing binder is changed by adding a plasticizer or other additives to a subject silver halide emulsion. For example, JP OPI Publication No. 2-135335/1990 discloses a technique in which a latex inherently comprising a methacrylate polymer having a glass transition temperature of lower than 50° C. and an emulsion containing tabular-shaped silver halide grains are used. However, this technique cannot be said to be desired and the effects thereof cannot be satisfactory. Therefore, the more excellent developments of the techniques have been demanded.

OBJECTS OF THE INVENTION

It is accordingly an object of the invention to provide a silver halide photographic emulsion capable of providing a silver halide photographic light sensitive material high in sensitivity and excellent in pressure resistance.

SUMMARY OF THE INVENTION

The above-mentioned object of the invention can be achieved by the following emulsion.

(1) A silver halide photographic emulsion comprising silver halide grains and a dispersion medium, wherein the silver halide grains to be contained in the emulsion are prepared by making use of seed grains and, before substantially starting the growth of the silver halide grains from the seed grains, an oxidizer is added into the dispersion medium in which the silver halide grains are grown;

(2) The silver halide photographic emulsion described in the above article (1), wherein the oxidizer is a halogen element;

(3) The silver halide photographic emulsion described in the above article (1), wherein the oxidizer is iodide;

DETAILED DESCRIPTION OF THE INVENTION

After having enormously studied the above-mentioned problems, the present inventors have discovered that the invention can be achieved with a silver halide photographic emulsion containing silver halide grains grown up by making use of seed grains, wherein the silver nuclei on the surfaces of the seed grains are oxidized.

It has been previously known that silver micronuclei can function as electron traps in silver halides. However, it has not heretofore been recognized that silver nuclei at the interfaces of the seed grains within the silver halides have a substantial and important effect on the sensitivity and pressure resistance of silver halide light sensitive materials. It has been found particularly advantageous to eliminate or reduce the number of silver nuclei present at the interfaces between seed grains by treating them with an oxidizer during grain growth.

The silver halide photographic emulsions of the invention can be applied with any one of silver halides such as silver bromide, silver iodobromide, silver iodochloride, silver chlorobromide, silver chloroiodobromide each applicable to the ordinary silver halide emulsions. Among them, silver bromide, silver iodobromide and silver chloroiodobromide are particularly desirable.

The silver halide grains contained in the silver halide photographic emulsions of the invention may be either the grains such as those in which a latent image is mainly formed on the surfaces thereof or the grains such as those in which a latent image is mainly formed in the inside of the grains.

The silver halide grains contained in the silver halide photographic emulsions of the invention may have either a regularly shaped crystal form such as those of a cube, an octahedron and a tetradecahedron or an irregularly shaped crystal form such as those of a spherically shaped or tabular-shaped one. In these grains, it is allowed to use those having any desired ratio of the {100} faces to the {111} faces. These grains may have either complexed crystal forms or variously mixed crystal forms. It is however preferred to use twinned silver halide grains having two parallel twin planes.

A twinned crystal is a silver halide crystal having one or more twinned planes in a grains. The classification of the twinned crystal configurations are detailed in Klein and Moiser, "Photographische Korrespondenz" Vol 99, p. 99 and ibid., Vol. 100, p. 57.

There is no special limitation to the grain sizes of the silver halide grains contained in the silver halide photographic emulsions of the invention. However, the average grain sizes thereof are within the range of, desirably, 0.1 to 3.0 μm and, more desirably, 0.2 to 2.0 μm.

As for the silver halide photographic emulsions relating to the invention, it is allowed to use any desired ones such as a polydisperse type emulsion having a wide grain size distribution and a monodisperse type emulsion having a narrow grain size distribution. However, they are desired to be of the monodisperse type.

As for the monodisperse type silver halide emulsions, the weight of the silver halides having the grain sizes within the range of ±20% around the average grain size is to be desirably not less than 60%, more desirably not less than 70% and further desirably not less than 80% of the total weight of the silver halide grains.

The term, "an average grain size", is hereinafter defined as a grain size ri obtained when maximizing a product $ni \times ri^3$ of a frequency ni of grains having a grain size ri, (in which the significant figures are three and the figures of the lowest column are rounded).

The term, "a grain size", herein stated is defined as the diameter of a silver halide grain when the grain is spherically shaped and the diameter of a circular image having the same area as that converted from the area of a projective image obtained when the grain is unspherically shaped.

A grain size can be confirmed, for example, by photographing a subject grain upon magnifying them 10,000 to 70,000 times through an electron microscope and then by practically measuring the diameter of the printed grain or the projected area of the grain. (The numbers of the subject grains are to be not less than 1,000 at random.)

When the grain size distribution range is defined by the following formula, $$(\text{Standard deviation}/\text{Average grain size}) \times 100 = \text{Distribution range } (\%),$$

the grain size distribution range of the particularly desirable highly monodisperse type emulsions of the invention is not more than 20% and, more desirably, not more than 15%.

In this case, the above-mentioned average grain sizes and standard deviation values are to be obtained from the above-defined grain size ri.

In the case where silver iodobromide is used in the invention, the silver iodide content of the silver iodobromide is within the range of, desirably, not less than 4 mol % to not more than 15 mol % and, more desirably, 6.0 to 10.0 mol %, each in terms of the average silver iodide content of the total silver grains.

In the silver halide photographic emulsions of the invention, the silver halide grains thereof are desirable to be the so-called core/shell type grains in which silver iodide is concentrated.

The above-mentioned core/shell type grains are those comprising the cores serving as the nuclei and the shells covering the cores. The shells are formed of a single layer or plural layers. The silver iodide contents of the cores and shells are each desired to be different from each other. It is particularly desired that the core sections are to be formed so as to maximize the silver iodide contents thereof.

The silver iodide contents of the above-mentioned cores are to be desirably not less than 10 mol % to not more than the maximum solid solubility, more desirably not less than 20 mol % to not more than the maximum solid solubility, and still more desirably not less than 25 mol % to not more than the maximum solid solubility.

The term, "The maximum solid solubility", herein stated is the maximum iodide content which is capable to form solid solution in silver halide crystals, and is detailed in T. H. James etal., "The Theory of Photographic Process" Forth Edition, Macmillan Publishing Co., Inc., P4 and is defined by following formula in the case of silver iodobromide.

Maximum amount of iodide (mol %)=34.5+0.165 (t-25) wherein t is the temperature of precipitation in C°.

Among the shells, the outermost shell ordinarily forming the outermost layer is to have a silver iodide content of, desirably not more than 5 mol % and more desirably within the range of 0 to 2 mol %. The proportion of the cores is within the range of, desirably 2 to 60% of the volume of the whole grain and more desirably 5 to 50%.

In the silver halide photographic emulsions of the invention, the silver halide grains thereof can be prepared in the manner that seed grains and an aqueous solution containing protective colloid are made present in advance in a reaction chamber and the seed grains are then grown up to be crystallized by supplying silver ions, halogen ions or silver halide fine grains, if required. In this case, the seed grains can be prepared in a single-jet method, a controlled double-jet method or the like which have been well-known in the art. Any halide compositions of the seed grains may be used. For example, any one of silver bromide, silver iodide, silver chloride, silver iodobromide, silver chlorobromide, silver chloroiodide and silver chloroiodobromide may be used. Among them, silver bromide and silver iodobromide may desirably be used.

The seed grains applicable to the invention may be either of the regular crystal forms such as a cube, an octahedron and a tetradecahedron or of the irregular crystal forms such as a spherical form and a tabular form. In these grains, any ratios of the {100} face to {111} face can be used. These grains may have a composite crystal form and may also be mixed with various crystal formed grains. Among these grains, the monodisperse type spherically-shaped seed grains described in JP Application No. 2-408178/1990 may desirably be used.

As for the methods of forming the silver halide photographic emulsions relating to the invention, various methods having been well-known in the art can be used. For example, any desired combinations of a single-jet method, a double-Jet method and a triple--Jet method can be used. It is also allowed to make combination use of such a method that the pAg and pH of a liquid phase in which silver halide is produced are so controlled as to meet the growth rate of the silver halide.

The silver halide photographic emulsions of the invention can be prepared in any one of an acidic method, a neutral method and an ammoniacal method. It is however desired to use an aqueous ammoniacal silver nitrate solution having a pH of not higher than 10.5 as described in JP Application No. 2-23713/1990 and then to produce silver halide at a pH of not higher than 7.5 as described in JP Application No. 2-23336/1990.

In preparing the silver halide photographic emulsions of the invention, it is allowed either to mix halide ions and silver ions together at the same time or to mix one into the other in the presence of the other. Taking the critical growth rate of silver halide crystals into consideration, the silver halide crystals may also be grown up by adding the halide ions and silver ions one by one or at the same time while controlling the pAg and pH in a mixing chamber. The silver halide composition of the grains may further be changed by making use of a conversion method in any desired silver halide producing process. It is still further allowed to supply halide ions and silver ions in the forms of silver halide fine grains into a mixing chamber.

In the silver halide photographic emulsions of the invention, it is characterized to add an oxidizer into a dispersion medium in which the silver halide grains are grown up by making use of the seed grains, before the growth of silver halide grains from the seed grains are substantially started in the dispersion medium.

The expression, "a growth is substantially started" in the invention means that silver halides are started to precipitately adhere to the surfaces of the seed grains by an aqueous solution containing silver ions and halide ions added to a dispersion medium or silver ions and halide ions supplied onto the seed surfaces from silver halide fine grains added to the dispersion medium.

In the invention, an oxidizer may be added at any desired time into a dispersion medium in which silver halide grains are grown up, provided that the oxidizer is added before the silver halide grains are started to be substantially grown up from seed grains. The oxidizer may be added in advance to the dispersion medium or it may be added at the same time when the seed grains are added into the dispersion medium. It may also be added at any time after adding the seed grains into the dispersion medium and before starting the addition of silver ions, halide ions or silver halide fine grains into the dispersion medium. It is desired to add it in advance into the dispersion medium within 120 minutes before adding the seed grains into the dispersion medium and within 180 minutes before starting the substantial growth of the silver halide grains from the seed grains. It is more desired to add it in advance into the dispersion medium within 60 minutes before the seed grains are added into the dispersion medium and within 120 minutes before starting the substantial growth of the silver halide grains from the seed grains.

The oxidizer applicable to the invention means a compound capable of converting metal silver into silver ions. The silver ions produced thereby are allowed to form the silver salts such as silver halides which are hardly soluble to water or they are also allowed to form the silver salts having a high solubility to water.

In the invention, any organic and inorganic oxidizers may be used either. For example, an organic peroxide and a quinone, a peroxy acid salt, ozone, hydrogen peroxide and the compounds thereof, a halogen element and so forth may desirably be used. Among them, halogen elements are desirably used and iodine may most desirably be used.

In the invention, the oxidizers may be added in an amount within the range of, desirably not less than $10^{-8}$ mols to not more than $10^{-1}$ mols, more desirably not less than $10^{-7}$ mols to not more than $10^{-2}$ mols and, desirably in particular not less than $10^{-6}$ mols to not more than $10^{-3}$ mols, each per mol of silver halide grains to be used in the invention.

In the invention and when adding an oxidizer into a dispersion medium, it is allowed to apply a method for adding an additive into a silver halide emulsion, which has generally been applied in the art. The compounds hardly soluble or insoluble to water are dissolved in advance in a suitable organic solvent such as an alcohol, a ketone and a glycol, and the water-soluble compounds are prepared to be an aqueous solution. The resulting solutions may then be added into a dispersion medium in which silver halide grains are grown up so as to be contained in the silver halide emulsions of the invention. When a halogen element including particularly iodine is used as an oxidizer, it is desired to dissolve it in advance into an alcohol and then to add the resulting solution into the dispersion medium.

In the invention, an oxidizer may be added at a time or not less than two times by separating them into several parts into a dispersion medium in which silver halide grains are grown up so as to be contained in the silver halide emulsions of the invention. Such an oxidizer may be added in advance when preparing a dispersion medium in which silver halide grains are grown up or it may also be added after preparing the dispersion medium. Further, it may be added within a short time by making use of a funnel or the like, or it may also be added at a flow rate using a pattern of some function by making use of a pump or the like.

In preparing the silver halide photographic emulsions of the invention, it is allowed to make present a well-known silver halide solvent such as ammonia, thioether, thiourea and so forth.

The silver halide grains which are to be contained in the silver halide photographic emulsions of the invention may be added with metal ions by making use of a cadmium salt, a zinc salt, a lead salt, a thallium salt, an iridium salt (including the complex salts thereof), a rhodium salt (including the complex salts thereof), an iron salt (including the complex salts thereof) and so forth in the processes of forming and/or growing the grains and thereby those metal elements may be contained inside the grains and/or the surfaces thereof. Also, a reduction sensitization nuclei can be provided to the inside of the grains and/or the surfaces thereof by placing the grains in a suitable reducible atmosphere.

From the silver halide photographic emulsions of the invention, any unnecessary soluble salts may be removed after completing the growth of the silver halide grains or may remain contained. When removing the unnecessary salts, the removal thereof can be performed in accordance with the method described in Research Disclosure (hereinafter abbreviated to as RD) No. 17643, Article II.

In preparing the silver halide photographic emulsions relating to the invention, the optimum conditions other than the above may be selected with reference to the well-known methods described in JP OPI Publication Nos. 61-6643/1986, 61-14630/1986, 61-112142/1986, 62-157024/1987, 62-18556/1987, 63-92942/1988, 63-151618/1988, 63-163451/1988, 63-220238/1988, 63-311244/1988 and so forth.

The silver halide photographic emulsions of the invention may desirably be used in silver halide color photographic light sensitive materials.

When a color photographic light sensitive material is constituted by making use of a silver halide photographic emulsion of the invention, the silver halide photographic emulsion having been physically ripened, chemically ripened and spectrally sensitized is used.

The additives to be used in such a process as mentioned above are given in Research Disclosure Nos. 17643, 19716 and 308119 (hereinafter abbreviated to as RD17643, RD18716 and RD308119). The places of the descriptions thereof will be shown below.

| [Item] | [Page of RD308119] | [RD17643] | [RD18716] |
|---|---|---|---|
| Chemical sensitizer | 996 III-A | 23 | 648 |
| Spectral sensitizer | 996 IV-A-A,B,C, D,H,I,J | 23~24 | 648~9 |
| Supersensitizer | 996 IV-A-E,J | 23~24 | 648~9 |
| Antifoggant | 998 VI | 24~25 | 649 |
| Stabilizer | 998 VI | 24~25 | 649 |

When a color photographic light sensitive material is constituted by making use of the silver halide photographic emulsions of the invention, the well-known photographic additives applicable thereto are also described in the abovementioned Research Disclosures. The places corresponding to the descriptions thereof will be shown below.

| [Item] | [Page of RD308119] | [RD17643] | [RD18716] |
|---|---|---|---|
| Color stain inhibitor | 1002 VII-I | 25 | 650 |
| Dye image stabilizer | 1001 VII-J | 25 | |
| Whitening agent | 998 V | 24 | |
| UV absorbent | 1003 VIII-C, XIIIC | 25~26 | |
| Light absorbent | 1003 VIII | 25~26 | |
| Light scattering agent | 1003 VIII | | |
| Filtering dye | 1003 VIII | 25~26 | |
| Binder | 1003 IX | 26 | 651 |
| Antistatic agent | 1006 XIII | 27 | 650 |
| Layer hardener | 1004 X | 26 | 651 |
| Plasticizer | 1006 XII | 27 | 650 |
| Lubricant | 1006 XII | 27 | 650 |
| Activator.Coating aid | 1005 XI | 26~27 | 650 |
| Matting agent | 1007 XVI | | |
| Developing agent (contained in a light sensitive material) | 1011 XX-B | | |

When a color photographic light sensitive material is constituted by making use of the silver halide photographic emulsions of the invention, various types of couplers may be used. The typical examples of the couplers are given in the foregoing Research Disclosures. The places corresponding to the descriptions thereof will be shown below.

| [Item] | [Page of RD308119] | [RD17643] |
|---|---|---|
| Yellow coupler | 1001 VII-D | VIIC~G |
| Magenta coupler | 1001 VII-D | VIIC~G |
| Cyan coupler | 1001 VII-D | VIIC~G |
| Colored coupler | 1002 VII-G | VIIG |
| DIR coupler | 1001 VII-F | VIIF |
| BAR coupler | 1002 VII-F | |
| Other useful residual groups | | |
| Split off coupler | 1001 VII-F | |
| Alkali-soluble coupler | 1001 VII-E | |

When a color photographic light sensitive material is constituted by making use of the silver halide photographic emulsions of the invention, the additives applicable thereto may be added in the dispersion methods and so forth each described in RD308119 XIV.

When a color photographic light sensitive material is constituted by making use of the silver halide photographic emulsions of the invention, such a support as mentioned in the foregoing RD17643, p. 28; RD18716, pp. 647~8; and RD308119, XVII may be used.

In the color photographic light sensitive materials applied with the silver halide photographic emulsions of the invention, the auxiliary layers including a filter layer and an interlayer such as those mentioned in the foregoing RD308119 VII-K may be provided thereto.

The color photographic light sensitive materials applied with the silver halide photographic emulsions of the invention can have various layer arrangements such as regular, inverse and unit layer arrangements each described in the foregoing RD308119 VII-K.

The silver halide photographic emulsions of the invention can desirably be applied to various color photographic light sensitive materials including, typically, color negative films for general or cinematographic use, color reversal films for slide or TV use, color papers, color positive films and color reversal papers.

The color photographic light sensitive materials applied with the silver halide photographic emulsions of the invention can be developed in the ordinary processes described in the foregoing RD17643, pp. 28~29; RD18716, p. 615; and RD308119 XIX.

EXAMPLES

The invention will be detailed with reference to the following examples. It is, however, to be understood that the invention shall not be limited thereto.

Example 1

(1) Preparation of spherical seed emulsion (Em-1)

With reference to JP Application No. 2-408178/1990, a monodisperse spherical seed emulsion (Em-1) was prepared in the following process.

| | |
|---|---|
| (Solution J) | |
| Ossein gelatin | 80 g |
| Potassium bromide | 47.4 g |
| A 10% methanol solution of sodium polyisopropylene-polyethyleneoxy-disuccinate | 20 cc |
| Add water to make | 8 liters |
| (Solution K) | |
| Silver nitrate | 1.2 kg |
| Add water to make | 1.6 liters |
| (Solution L) | |
| Ossein gelatin | 32.2 g |
| Potassium bromide | 840 g |
| Add water to make | 1.6 liters |
| (Solution M) | |
| Aqueous ammonia | 470 cc |

(Solution K) and (Solution L) were added to (Solution J) violently stirred at 40° C. by taking 11 minutes, so that the nuclei were produced. In this course, pBr was kept at 1.60.

After that, the temperature was lowered to 30° C. by taking 12 minutes and a ripening treatment was carried out for 18 minutes. Further, (Solution M) was added thereto by taking one minute and, successively, a ripening treatment was carried out for 5 minutes. In the course of the ripening treatments, kBr concentration was 0.07 mols/liter and the ammoniacal concentration was 0.63 mols/liter.

After completing the ripening treatments, the pH was controlled to be 6.0 and a desalting treatment was carried out in an ordinary method. When the resulting seed emulsion grains were observed through an electron microscope, they were proved to be a spherical emulsion having two parallel twin planes and an average grain size of 0.318 μm.

(2) Preparation of Comparative Emulsion (Em-2)

Comparative emulsion (Em-2) was prepared by making use of the following 8 kinds of solutions.

| | |
|---|---|
| (Solution A) | |
| Ossein gelatin | 268.2 g |
| Distilled water | 4.0 liters |
| A 10% methanol solution of sodium polyisopropylene-polyethyleneoxy-disuccinate | 1.5 cc |
| An aqueous 28 wt % ammonia solution | 528.0 cc |
| An aqueous 58 wt % acetic acid solution | 795.0 cc |
| Add distilled water to make | 5390.0 cc |
| (Solution B) | |
| An aqueous 3.5N ammoniacal silver nitrate solution (The pH of the solution was controlled to be 9.0 with ammonium nitrate.) | |
| (Solution C) | |
| An aqueous 3.5N potassium bromide solution containing 4.0 wt % gelatin | |
| (Solution D) | |
| A fine grained emulsion comprising 3 wt % gelatin and silver iodide grains (having an average grain size of 0.05 μm) | 2.39 mols |

The preparation process will be shown below.

Both of 2000 cc of an aqueous solution containing 7.06 mols of silver nitrate and 2000 cc of an aqueous solution containing 7.06 mols of potassium iodide were each added by taking 10 minutes into 5000 cc of a 6.0 wt % gelatin solution containing 0.06 mols of potassium iodide. In the course of forming fine grains, the pH was controlled to be 2.0 by making use of nitric acid and the temperature was controlled to be at 40° C. After completing the formation of the grains, the pH was controlled to be 6.0 by making use of an aqueous sodium carbonate solution.

| | |
|---|---|
| (Solution E) | |
| A fine grained emulsion prepared in the same manner as in the silver iodide fine grained emulsion described of (Solution D) so as to comprise silver iodobromide grains (having an average grain size of 0.04 μm) containing 1 mol % silver iodide wherein the temperature was controlled to be 30° C. in the course of forming the fine grains. | 6.24 mols |
| (Solution F) | |
| An aqueous 1.75N potassium bromide solution | |
| (Solution G) | |
| An aqueous 56 wt % acetic acid solution | |
| (Solution H) | |
| Seed emulsion (Em-1) | 0.286 mols |

After adding (Solution H) to (Solution A) kept at 70° C. in a reaction chamber, (Solution B), (Solution C) and (Solution D) were added thereto in a double-jet method by taking 163 minutes and, successively, (Solution E) was independently and constantly added for 12 minutes, so that the seed crystals were grown to be 1.0 μm.

The adding rates of (Solution B) and (Solution C) were functionally changed in relation to the period of time so as to meet the critical growth rate and the solutions were then added at a suitable adding rate so as not to be polydispersed by producing small-sized grains other than the seed crystals being grown there or by an Ostwald ripening phenomenon. (Solution D) that was the silver iodide fine grained emulsion was supplied by changing the supplying rate (in terms of mol ratio) thereof to the aqueous ammoniacal silver nitrate solution in relation to the grain sizes (or the adding time), as shown in Table 1, so that a multilayer structured core/-shell type silver halide emulsion could be prepared.

In the course of growing the crystals, the pAg and pH were controlled by making use of (Solution F) and (Solution G), as shown in Table 1. The pAg and pH were measured in an ordinary method by making use of a silver sulfide electrode and a glass electrode.

TABLE 1

| | Adding time (min) | Grain size (μm) | Flow rate (Solution D) | pH | pAg |
|---|---|---|---|---|---|
| Interlayer | 0.0 | 0.318 | 10.3 | 7.2 | 7.8 |
| | 23.1 | 0.432 | 10.3 | 7.2 | 7.8 |
| | 38.0 | 0.495 | 10.3 | 7.2 | 7.8 |
| Core section | 50.1 | 0.538 | 30.0 | 7.2 | 7.8 |
| | 82.6 | 0.657 | 30.0 | 7.2 | 7.8 |
| | 82.6 | 0.657 | 30.0 | 6.5 | 9.4 |
| Shell section | 112.7 | 0.706 | 30.0 | 6.5 | 9.4 |
| | 122.0 | 0.723 | 10.3 | 6.5 | 9.4 |
| | 141.6 | 0.781 | 7.7 | 6.5 | 9.4 |
| | 141.6 | 0.781 | 0.0 | 6.5 | 9.4 |
| | 163.0 | 0.925 | 0.0 | 6.5 | 9.7 |

After completing the formation of the grains, a desalting treatment was carried out in the method described in JP Application No. 3-41314/1991. The a redispersion was carried out by adding gelatin and then the pH and pAg were adjusted to be 5.80 and 8.06 at 40° C., respectively.

From the photograph of the resulting emulsion grains taken by a scanning type electron microscope, the resulting emulsion was proved to be an octahedral twinned monodisperse type emulsion having an average grain size of 1.0 μm and a distribution range of 10.3%.

(3) Preparation of Emulsion (Em-3) of the Invention

Emulsion (Em-3) of the invention was prepared in quite the same manner as in emulsion (Em-2), except that the following (Solution I-1) was added by taking 3 seconds into (Solution A) 60 minutes before adding (Solution H) and 90 minutes before starting the addition of (Solution B), (Solution C) and (Solution D) to (Solution A). The resulting emulsion was proved to be an octahedral twinned monodisperse type emulsion having an average grain size of 1.0 μm and a distribution range of 11.3%.

| (Solution I-1) | |
|---|---|
| An aqueous solution containing bromide of 0.001 mols per mol of silver halide grains of emulsion (Em-2) | 50.0 cc |

(4) Preparation of Emulsion (Em-4) of the Invention

Emulsion (Em-4) of the invention was prepared in quite the same manner as in emulsion (Em-2), except that the following (Solution I-2) was added by taking 3 seconds into (Solution A) 60 minutes before adding (Solution H) and 90 minutes before starting the addition of (Solution B), (Solution C) and (Solution D) to (Solution A). The resulting emulsion was proved to be an octahedral twinned monodisperse type emulsion having an average grain size of 1.0 μm and a distribution range of 11.0%.

| (Solution I-2) | |
|---|---|
| A methanol solution containing iodine of 0.001 mols per mol of silver halide grains of emulsion (Em-2) | 50.0 cc |

(5) Preparation of Emulsion (Em-5) of the Invention

Emulsion (Em-5) of the invention was prepared in quite the same manner as in emulsion (Em-2), except that the following (Solution I-3) was added by taking 3 seconds into (Solution A) 60 minutes before adding (Solution H) and 90 minutes before starting the addition of (Solution B), (Solution C) and (Solution D) to (Solution A). The resulting emulsion was proved to be an octahedral twinned monodisperse type emulsion having an average grain size of 1.0 μm and a distribution range of 12.1%.

| (Solution I-3) | |
|---|---|
| A methanol solution containing iodine of 0.0005 mols per mol of silver halide grains of emulsion (Em-2) | 50.0 cc |

(6) Preparation of Emulsion (Em-6) of the Invention

Emulsion (Em-6) of the invention was prepared in quite the same manner as in emulsion (Em-2), except that the following (Solution I-4) was added by taking 3 seconds into (Solution A) 20 minutes after adding (Solution H) and 10 minutes before starting the addition of (Solution B), (Solution C) and (Solution D) to (Solution A). The resulting emulsion was proved to be an octahedral twinned monodisperse type emulsion having an average grain size of 1.0 μm and a distribution range of 10.4%.

| (Solution I-4) | |
|---|---|
| A methanol solution containing iodine of 0.001 mols per mol of silver halide grains of emulsion (Em-2) | 50.0 cc |

(7) Preparation of Emulsion (Em-7) of the Invention

Emulsion (Em-7) of the invention was prepared in quite the same manner as in emulsion (Em-2), except that the following (Solution I-5) was added by taking 3 seconds into (Solution A) 60 minutes before adding (Solution H) and 90 minutes before starting the addition of (Solution B), (Solution C) and (Solution D) to (Solution A). The resulting emulsion was proved to be an octahedral twinned monodisperse type emulsion having an average grain size of 1.0 μm and a distribution range of 10.9%.

| (Solution I-5) | |
|---|---|
| An aqueous solution containing hydrogen peroxide of 0.001 mols per mol of silver halide grains of emulsion (Em-2) | 50.0 cc |

(8) Preparation of Emulsion (Em-8) of the Invention

Emulsion (Em-8) of the invention was prepared in quite the same manner as in emulsion (Em-2), except that the following (Solution I-6) was added by taking 3 seconds into (Solution A) 60 minutes before adding (Solution H) and 90 minutes before starting the addition of (Solution B), (Solution C) and (Solution D) to (Solution A). The resulting emulsion was proved to be an octahedral twinned monodisperse type emulsion having an average grain size of 1.0 μm and a distribution range of 10.7%.

| (Solution I-6) | |
|---|---|
| An aqueous solution containing hydrogen peroxide of 0.0005 mols per mol of silver halide grains of emulsion (Em-2) | 50.0 cc |

(9) Preparation of Emulsion (Em-9) for Comparison

Emulsion (Em-9) for the comparison was prepared in quite the same manner as in emulsion (Em-2), except that the following (Solution I-7) was added by taking 3 seconds into (Solution A) 60 minutes after adding (Solution H) and 30 minutes after starting the addition of (Solution B), (Solution C) and (Solution D) to (Solution A). The resulting emulsion was proved to be an octahedral twinned monodisperse type emulsion having an average grain size of 1.0 μm and a distribution range of 11.0%.

| (Solution I-7) | |
|---|---|
| An aqueous solution containing hydrogen peroxide of 0.001 mols | 50.0 cc |

(Em-2) through (Em-9) were coated over sublayered transparent triacetate cellulose film supports, respectively, in the following manner, so that the light sensitive materials could be prepared.

The following magenta coupler (M-1) of 5 g, 0.95 g of the following colored magenta coupler (CM-1) and 0.10 g of the following DIR compound (D-1) were dissolved in 5 cc of dibutyl phthalate. The resulting solution was mixed with 8 cc of an aqueous 10% solution of Alkanol B (alkylnaphthalene sulfonate manufactured by DuPont) and 70 cc of an aqueous 5% gelatin solution and the resulting mixture was emulsified and dispersed by making use of a colloid mill.

M-1

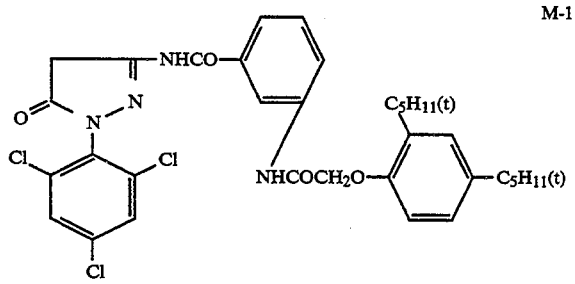

CM-1

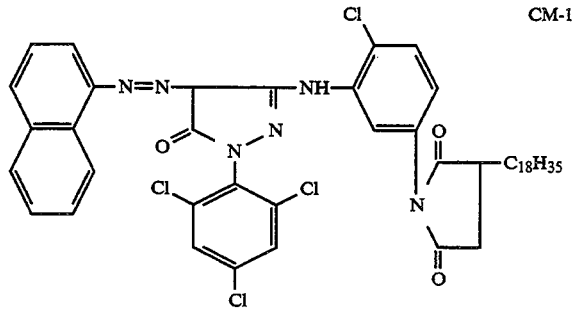

-continued

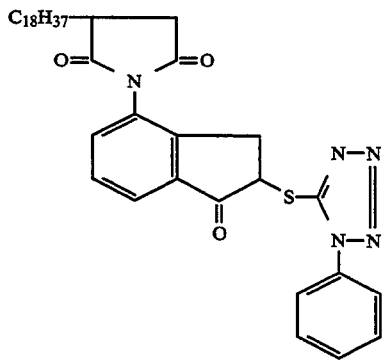

D-1

The resulting dispersed solution, (Em-2) through (Em-9) and 350 g of an emulsion (containing 40 g of silver) which was subjected to the optimum sulfur sensitization, gold sensitization and color sensitization to be green sensitive were mixed together, respectively. The resulting mixtures were so coated as to be 16 mg/dm$^2$ in terms of silver coating weight, respectively.

Next, a protective layer containing gelatin in an amount of 2.3 g (per sq.meter) over each of the above-mentioned resulting coated layers, so that Samples 11 through 18 were prepared.

These samples were each exposed to white light for sensitometry and they were then processed in the following processing steps. The sensitivities of the processed samples were each evaluated.

For the purpose of evaluating the pressure resistance of the samples, each sample was bent round a cylinder having a diameter of 4 mm. They were then exposed to light in the same manner as above and were then processed.

| Processing step (at 38° C.) | |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing solutions used in the above-mentioned processing steps were as follows.

| | |
|---|---|
| <Color developer> | |
| 4-amino-3-methyl-N-methyl-N-(β-hydroxyethyl) aniline.sulfate | 4.75 g |
| Sodium sulfite, anhydrous | 4.25 g |
| Hydroxylamine.½ sulfate | 2.0 g |
| Potassium carbonate, anhydrous | 37.5 g |
| Sodium bromide | 1.3 g |
| Trisodium nitrilotriacetate, (monohydrate) | 2.5 g |
| Potassium hydroxide | 1.0 g |
| Add water to make | 1 liter |
| Adjust pH to be | pH = 10.0 |
| <Bleacher> | |
| Iron ammonium ethylenediaminetetraacetate | 100.0 g |
| Diammonium ethylenediaminetetraaoetate | 10.0 g |
| Ammonium bromide | 150.0 g |
| Glacial acetic acid | 10.0 g |
| Add water to make | 1 liter |
| Adjust pH with aqueous ammonia to be | pH = 6.0 |
| <Fixer> | |
| Ammonium thiosulfate | 175.0 g |
| Sodium sulfite, anhydrous | 8.5 g |
| Sodium metasulfite | 2.3 g |
| Add water to make | 1 liter |
| Adjust pH with acetic acid to be | pH = 6.0 |
| <Stabilizer> | |
| Formalin (in an aqueous 37% solution) | 1.5 cc |
| Konidux (manufactured by Konica Corp.) | 7.5 cc |
| Add water to make | 1 liter |

The relative sensitivity is a value relative to the reciprocal of a light receiving quantity capable of providing a density of a fog density+0.1 and, in this case, the green sensitivity of Sample 11 was regarded as a value of 100.

In the portions applied with pressure by bending a sample, the density variations of each sample were obtained in the manner that, at the density point of a fog density+0.15, the densities in the pressed and unpressed portions were each measured by a microdensitometer. The density variations of each sample were obtained in the following manner and were then indicated by the values relative to that of Sample 11 which was regarded as a value of 100, (which are the values of the relative density variations)

Density variation in a pressed portion=[(Density in the pressed portion−Density in an unpressed portion)/0.15]×100 (%)

Table 2 shows the relative sensitivities of Samples 11 through 18 in which Emulsions (Em-2) through (Em-9) were used and the results of the evaluation of the relative density variations in the pressed portions, respectively.

TABLE 2

| Sample | Emulsion used | | Kind of oxidizer | Amt of oxidizer added (mols/mol of Ag) | Adding time of oxidizer: Relative to the addition of seed emulsion | Adding time of oxidizer: Relative to the start of grain growth | Relative sensitivity | Relative density variation in pressed portion |
|---|---|---|---|---|---|---|---|---|
| Sample 11 | Em-2 | Comparison | — | — | — | — | 100 | 100 |
| Sample 12 | Em-3 | Invention | Bromine | 0.001 | 60 min before | 90 min before | 113 | 70 |
| Sample 13 | Em-4 | Invention | Iodine | 0.001 | 60 min before | 90 min before | 115 | 50 |
| Sample 14 | Em-5 | Invention | Iodine | 0.0005 | 60 min before | 90 min before | 115 | 54 |
| Sample 15 | Em-6 | Invention | Iodine | 0.001 | 20 min after | 10 min before | 113 | 60 |
| Sample 16 | Em-7 | Invention | Hydrogen peroxide | 0.001 | 60 min before | 90 min before | 105 | 88 |

TABLE 2-continued

| Sample | Emulsion used | | Kind of oxidizer | Amt of oxidizer added (mols/mol of Ag) | Adding time of oxidizer: Relative to the addition of seed emulsion | Adding time of oxidizer: Relative to the start of grain growth | Relative sensitivity | Relative density variation in pressed portion |
|---|---|---|---|---|---|---|---|---|
| Sample 17 | Em-8 | Invention | Hydrogen peroxide | 0.0005 | 60 min before | 90 min before | 109 | 79 |
| Sample 18 | Em-9 | Comparison | Hydrogen peroxide | 0.001 | 60 min after | 3 min after | 102 | 107 |

It is proved from the contents of Table 2 that, as compared to the samples applied with the comparative emulsions, every one of the samples (Samples 12 through 17) applied with the silver halide emulsions of the invention (Em-3 through Em-8) displayed the characteristics so excellent that the relative sensitivities were high and the density variations in the pressed portions were not very much. When making use of bromine as an oxidizer (such as in Sample 12), more excellent characteristics could be displayed than in the case of making use of hydrogen peroxide (such as in Samples 16 and 17) and, when making use of iodine (such as in Samples 13 through 15), the results thereof were farther more effective. In addition, when adding an oxidizer before adding seed emulsion (such as in Sample 13), more excellent characteristics could be displayed than in the case where an oxidizer was added after adding seed emulsion and before substantially starting the growth (such as in Sample 15).

Example 2

Silver halide emulsions (Em-2) through (Em-9) were each subjected to an optimum chemical sensitization. The resulting emulsions were each designated as (Emulsion-A) and used in the following sample composition.

Multilayered color photographic light sensitive material samples 21 through 28 were each prepared by forming each of the layers having the following compositions in order from the side of a triacetyl cellulose film support.

Amounts of the compositions added are indicated by grams per sq.meter unless otherwise expressly stated. Silver halide and colloidal silver are indicated by converting them into the silver contents thereof. Sensitizing dyes are indicated by mols per mol of silver.

| | |
|---|---|
| Layer 1: An antihalation layer | |
| Black colloidal silver | 0.16 |
| UV absorbent (UV-1) | 0.20 |
| High boiling organic solvent (Oil-1) | 0.16 |
| Gelatin | 1.23 |
| Layer 2: An interlayer | |
| Compound (SC-1) | 0.15 |
| High boiling organic solvent (SC-2) | 0.17 |
| Gelatin | 1.27 |
| Layer 3: A low-speed red-sensitive layer | |
| Silver iodobromide emulsion (having an average grain size of 0.38 μm and a silver iodide content of 8.0 mol %) | 0.50 |
| Silver iodobromide emulsion (having an average grain size of 0.27 μm and a silver iodide content of 2.0 mol %) | 0.21 |
| Sensitizing dye (SD-1) | $2.8 \times 10^{-4}$ |
| Sensitizing dye (SD-2) | $1.9 \times 10^{-4}$ |
| Sensitizing dye (SD-3) | $1.9 \times 10^{-5}$ |
| Sensitizing dye (SD-4) | $1.0 \times 10^{-4}$ |
| Cyan coupler (C-1) | 0.48 |
| Cyan coupler (C-2) | 0.14 |

-continued

| | |
|---|---|
| Colored cyan coupler (CC-1) | 0.021 |
| DIR compound (D-1) | 0.020 |
| High boiling solvent (Oil-1) | 0.53 |
| Gelatin | 1.30 |
| Layer 4: A medium-speed red-sensitive layer | |
| Silver iodobromide emulsion (having an average grain size of 0.52 μm and a silver iodide content of 8.0 mol %) | 0.62 |
| Silver iodobromide emulsion (having an average grain size of 0.38 μm and a silver iodide content of 8.0 mol %) | 0.27 |
| Sensitizing dye (SD-1) | $2.3 \times 10^{-4}$ |
| Sensitizing dye (SD-2) | $1.2 \times 10^{-4}$ |
| Sensitizing dye (SD-3) | $1.6 \times 10^{-5}$ |
| Sensitizing dye (SD-4) | $1.2 \times 10^{-4}$ |
| Cyan coupler (C-1) | 0.15 |
| Cyan coupler (C-2) | 0.18 |
| Colored cyan coupler (CC-1) | 0.030 |
| DIR compound (D-1) | 0.013 |
| High boiling solvent (Oil-1) | 0.30 |
| Gelatin | 0.93 |
| Layer 5: A high-speed red-sensitive layer | |
| Silver iodobromide emulsion (Emulsion-A) | 1.27 |
| Sensitizing dye (SD-1) | $1.3 \times 10^{-4}$ |
| Sensitizing dye (SD-2) | $1.3 \times 10^{-4}$ |
| Sensitizing dye (SD-3) | $1.6 \times 10^{-5}$ |
| Cyan coupler (C-2) | 0.12 |
| Colored cyan coupler (CC-1) | 0.013 |
| High boiling solvent (Oil-1) | 0.14 |
| Gelatin | 0.91 |
| Layer 6: An interlayer | |
| Compound (SC-1) | 0.09 |
| High boiling organic solvent (Oil-2) | 0.11 |
| Gelatin | 0.80 |
| Layer 7: A low-speed green-sensitive layer | |
| Silver iodobromide emulsion (having an average grain size of 0.38 μm and a silver iodide content of 8.0 mol %) | 0.61 |
| Silver iodobromide emulsion (having an average grain size of 0.27 μm and a silver iodide content of 2.0 mol %) | 0.20 |
| Sensitizing dye (SD-4) | $7.4 \times 10^{-5}$ |
| Sensitizing dye (SD-5) | $6.6 \times 10^{-4}$ |
| Magenta coupler (M-1) | 0.18 |
| Magenta coupler (M-2) | 0.44 |
| Colored magenta coupler (CM-1) | 0.12 |
| High boiling solvent (Oil-2) | 0.75 |
| Gelatin | 1.95 |
| Layer 8: A medium-speed green-sensitive layer | |
| Silver iodobromide emulsion (having an average grain size of 0.59 μm and a silver iodide content of 8.0 mol %) | 0.87 |
| Sensitizing dye (SD-6) | $2.4 \times 10^{-4}$ |
| Sensitizing dye (SD-7) | $2.4 \times 10^{-4}$ |
| Magenta coupler (M-1) | 0.058 |
| Magenta coupler (M-2) | 0.13 |
| Colored magenta coupler (CM-1) | 0.070 |
| DIR compound (D-2) | 0.025 |
| DIR compound (D-3) | 0.002 |
| High boiling solvent (Oil-2) | 0.50 |
| Gelatin | 1.00 |
| Layer 9: A high-speed green-sensitive | |

-continued

| layer | |
|---|---|
| Silver iodobromide emulsion (Emulsion-A) | 1.27 |
| Sensitizing dye (SD-6) | $1.4 \times 10^{-4}$ |
| Sensitizing dye (SD-7) | $1.4 \times 10^{-4}$ |
| Magenta coupler (M-2) | 0.084 |
| Magenta coupler (M-3) | 0.064 |
| Colored magenta coupler (CM-1) | 0.012 |
| High boiling solvent (Oil-1) | 0.27 |
| High boiling solvent (Oil-2) | 0.012 |
| Gelatin | 1.00 |
| Layer 10: A yellow filter layer | |
| Yellow colloidal silver | 0.08 |
| Color stain inhibitor (SC-2) | 0.15 |
| Formalin scavenger (HS-1) | 0.20 |
| High boiling solvent (Oil-2) | 0.19 |
| Gelatin | 1.10 |
| Layer 11: An interlayer | |
| Formalin scavenger (HS-1) | 0.20 |
| Gelatin | 0.60 |
| Layer 12: A low-speed blue-sensitive layer | |
| Silver iodobromide emulsion (having an average grain size of 0.38 μm and a silver iodide content of 8.0 mol %) | 0.22 |
| Silver iodobromide emulsion (having an average grain size of 0.27 μm and a silver iodide content of 2.0 mol %) | 0.03 |
| Sensitizing dye (SD-8) | $4.9 \times 10^{-4}$ |
| Yellow coupler (Y-1) | 0.75 |
| DIR compound (D-1) | 0.010 |
| High boiling solvent (Oil-2) | 0.30 |
| Gelatin | 1.20 |
| Layer 13: A medium-speed blue-sensitive layer | |
| Silver iodobromide emulsion (having an average grain size of 0.59 μm and a silver iodide content of 8.0 mol %) | 0.30 |
| Sensitizing dye (SD-8) | $1.6 \times 10^{-4}$ |
| Sensitizing dye (SD-9) | $7.2 \times 10^{-5}$ |
| Yellow coupler (Y-1) | 0.10 |
| DIR compound (D-1) | 0.010 |
| High boiling solvent (Oil-2) | 0.046 |
| Gelatin | 0.47 |
| Layer 14: A high-speed blue-sensitive layer | |
| Silver iodobromide emulsion (Emulsion-A) | 0.85 |
| Sensitizing dye (SD-8) | $7.3 \times 10^{-5}$ |
| Sensitizing dye (SD-9) | $2.8 \times 10^{-5}$ |
| Yellow coupler (Y-1) | 0.11 |
| High boiling solvent (Oil-2) | 0.046 |
| Gelatin | 0.80 |
| Layer 15: Protective layer 1 | |
| Silver iodobromide emulsion (having an average grain size of 0.08 μm and a silver iodide content of 1.0 mol %) | 0.40 |

Besides the above-given compositions, there were added with coating aid Su-1, dispersion aid Su-2, a viscosity controller, layer hardeners H-1 and H-2, stabilizer ST-1, two kinds of antifoggants AF-1 and AF-2 having weight average molecular weights of 10,000 and 1,100,000, respectively and preservative DI-1 which was added in an amount of 9.4 mg/m$^2$.

The chemical structures of the compounds used in the samples will be shown below.

C-1

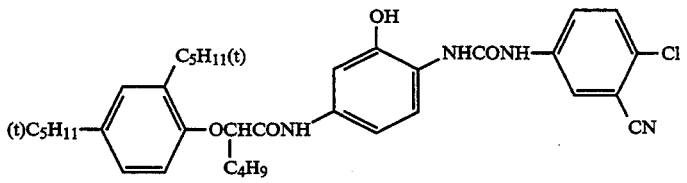

C-2

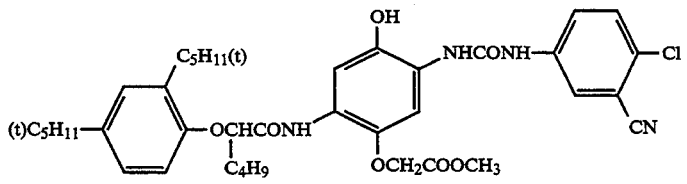

M-1

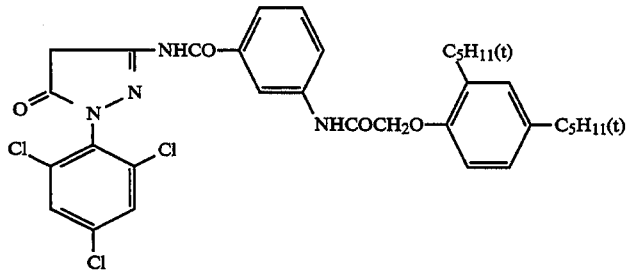

-continued
M-2
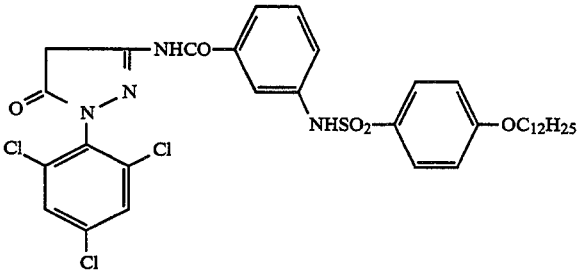
M-3
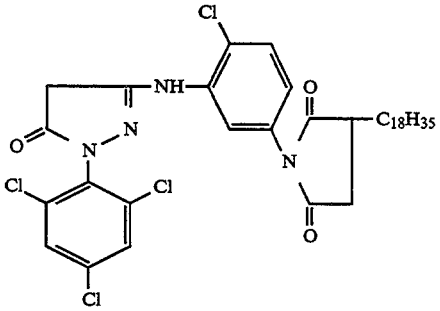
Y-1
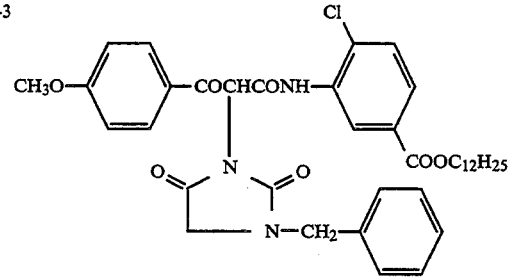
CC-1
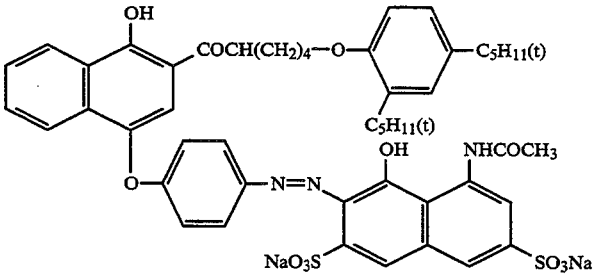
CM-1
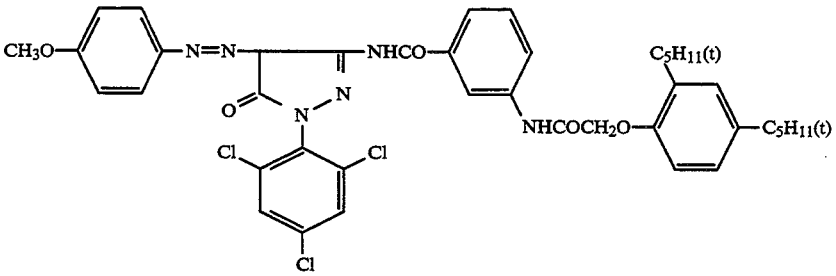
D-1
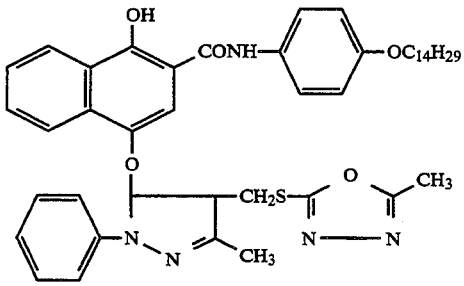
D-2
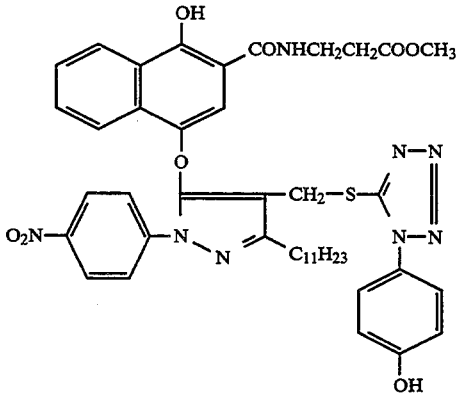

-continued
D-3
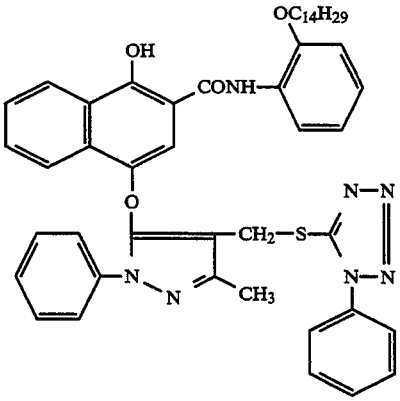
Oil-1
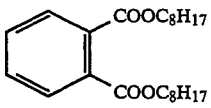
Oil-2
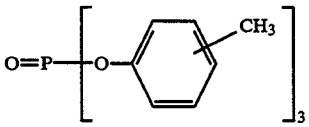
Oil-3
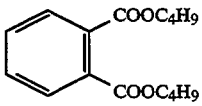
SC-1
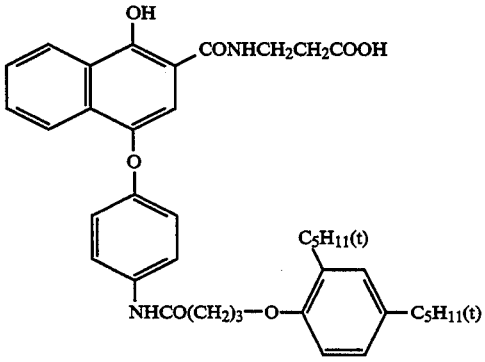
SC-2
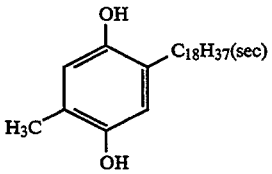
UV-1
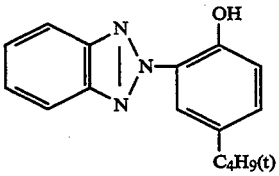
UV-2
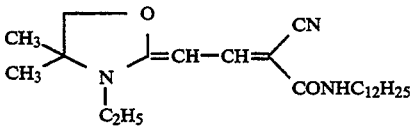
WAX-1
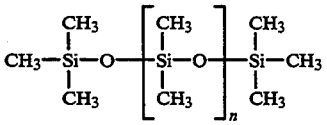
Weight average molecular weight MW: 3,000
Su-1
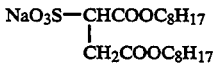
Su-2
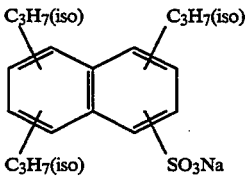
HS-1
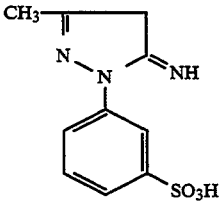
SD-1
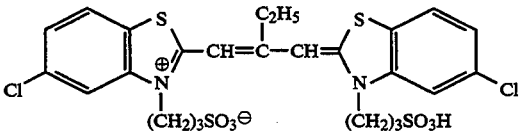
SD-2
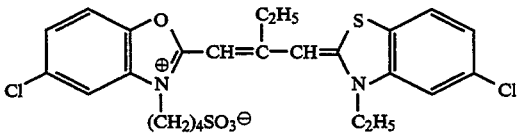

-continued
SD-3
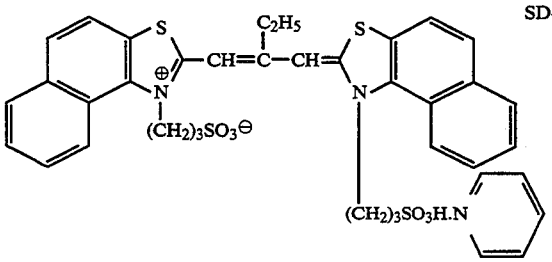
SD-4
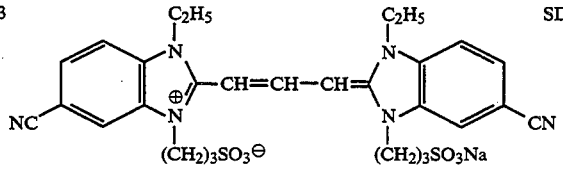
SD-5
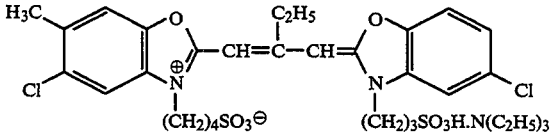
SD-6
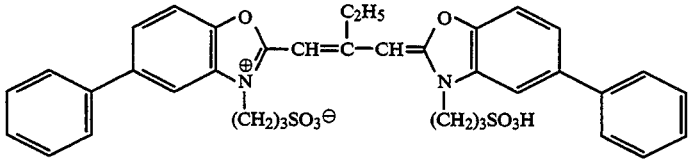
SD-7
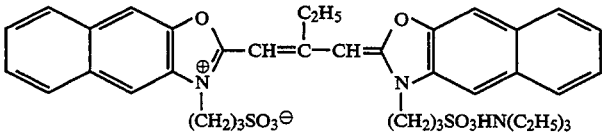
SD-8
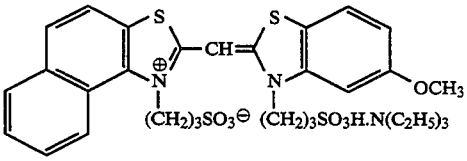
SD-9
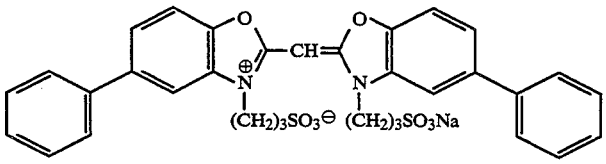
H-1
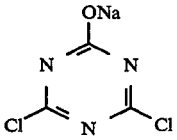
H-2
$(CH_2{=}CHSO_2CH_2)_2O$
ST-1
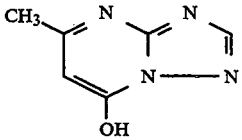
AF-1
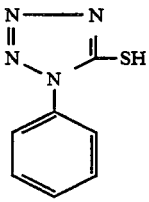
AF-2
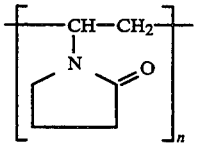
n: polymerization degree -continued (A mixture of the following 3 components) DI-1

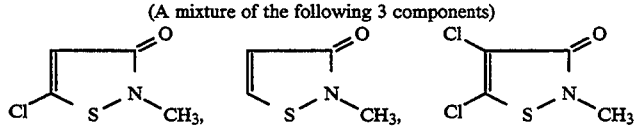

(Component A) (Component B) (Component C)

Components A:B:C = 50:46:4 (in mol ratio)

The samples were each exposed to white light for sensitometry and were then processed in the following processing steps, so that the sensitivities thereof were evaluated.

For evaluating the pressure resistance of the samples, each of the samples was bent round a cylinder having a diameter of 4 mm. Each of the exposed samples was exposed to light in the same manner as mentioned above and then developed.

| Processing step (made at 38° C.) | |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing solutions used in each processing step were as follows.

| | |
|---|---|
| <Color developer> | |
| 4-amino-3-methyl-N-ethyl-N-(β-hydroxyethyl)aniline.sulfate | 4.75 g |
| Sodium sulfite, anhydrous | 4.25 g |
| Hydroxylamine.½ sulfate | 2.0 g |
| Potassium carbonate, anhydrous | 37.5 g |
| Sodium bromide | 1.3 g |
| Trisodium nitrilotriacetate (monoyhydrate) | 2.5 g |
| Potassium hydroxide | 1.0 g |
| Add water to make | 1 liter |
| Adjust pH to be | pH = 10.0 |
| <Bleacher> | |
| Iron ammonium ethylenediamine tetraacetate | 100.0 g |
| Diammonium ethylenediamine tetraacetate | 10.0 g |
| Ammonium bromide | 150.0 g |
| Glacial acetic acid | 10.0 g |
| Add water to make | 1 liter |

-continued

| | |
|---|---|
| Adjust pH with aqueous ammonia to be | pH = 6.0 |
| <Fixer> | |
| Ammonium thiosulfate | 175.0 g |
| Sodium sulfite, anhydrous | 8.5 g |
| Sodium metasulfite | 2.3 g |
| Add water to make | 1 liter |
| Adjust pH with acetic acid to be | pH = 6.0 |
| <Stabilizer> | |
| Formalin (in an aqueous 37% solution) | 1.5 cc |
| Konidux (manufactured by Konica Corp.) | 7.5 cc |
| Add water to make | 1 liter |

About Samples 21 through 28, the relative sensitivities and relative densities in the pressed portions thereof were evaluated in the same manner and in Example 1.

Table 3 shows the results of the evaluation on Samples 21 through 28.

TABLE 3

| Sample | Emulsion used | | Kind of oxidizer | Amt of oxidizer added (mols/mol of Ag) | Adding time of oxidizer: Relative to the addition of seed emulsion | Adding time of oxidizer: Relative to the start of grain growth | Relative sensitivity | Relative density variation in pressed portion |
|---|---|---|---|---|---|---|---|---|
| Sample 21 | Em-2 | Comparison | — | — | — | — | 100 | 100 |
| Sample 22 | Em-3 | Invention | Bromine | 0.001 | 60 min before | 90 min before | 108 | 83 |
| Sample 23 | Em-4 | Invention | Iodine | 0.001 | 60 min before | 90 min before | 112 | 62 |
| Sample 24 | Em-5 | Invention | Iodine | 0.0005 | 60 min before | 90 min before | 111 | 69 |
| Sample 25 | Em-6 | Invention | Iodine | 0.001 | 20 min after | 10 min before | 106 | 77 |
| Sample 26 | Em-7 | Invention | Hydrogen peroxide | 0.001 | 60 min before | 90 min before | 105 | 91 |
| Sample 27 | Em-8 | Invention | Hydrogen peroxide | 0.0005 | 60 min before | 90 min before | 106 | 88 |
| Sample 28 | Em-9 | Comparison | Hydrogen peroxide | 0.001 | 60 min after | 30 min after | 102 | 105 |

It is proved from the contents of Table 3 that, as compared to the samples applied with the comparative emulsions, every one of the samples (Samples 22 through 27) applied with the silver halide emulsions of the invention (Em-3 through Em-9) displayed the characteristics so excellent that the relative sensitivities were high and the density variations in the pressed portions were not very much. When making use of bromine as an oxidizer (such as in Sample 22), more excellent characteristics could be displayed than in the case of making use of hydrogen peroxide (such as in Samples 26 and 27) and, when making use of iodine (such as in Samples 23 through 25), the results thereof were farther more effective. In addition, when adding an oxidizer before adding seed emulsion (such as in Sample 23), more excellent characteristics could be displayed than in the case where an oxidizer was added after adding seed emulsion and before substantially starting the growth (such as in Sample 25).

According to the invention, it is possible to provide a silver halide photographic emulsion capable of providing a silver halide photographic light sensitive material high in sensitivity and excellent in pressure resistance.

What is claimed is:

1. A silver halide photographic emulsion which comprises a dispersion medium and silver halide grains, wherein said silver halide grains are prepared by a process comprising the steps of:

(a) preparing a dispersion medium, wherein said dispersion medium comprises a gelatin solution, (b) introducing an oxidizer into said dispersion medium; and thereafter (c) introducing silver halide seed grains.

2. The emulsion of claim 1, wherein said oxidizer is selected from the group consisting of an organic peroxide, a quinone, a peroxy acid salt, an ozone, a hydrogen peroxide and a halogen element.

3. The emulsion of claim 1, wherein an introduced amount of said oxidizer is within the range of $10^{-8}$ to $10^{-1}$ mols per mol of silver halide grains.

4. The emulsion of claim 1, wherein said silver halide seed grains comprises twinned silver halide grains.

5. The emulsion of claim 4, wherein said twinned silver halide grains comprises two parallel twin planes.

6. The emulsion of claim 1, wherein the average grain size of said silver halide grains is within the range of 0.1 μm to 3 μm.

7. The emulsion of claim 1, wherein the average grain size of said silver halide grains is within the range of 0.2 μm to 2 μm.

8. The emulsion of claim 1, wherein said silver halide emulsion is a monodisperse type emulsion, wherein:

the weight of silver halide grains having a grain size within the range of ±20% around the average grain size is not less than 60% of the total weight of the silver halide grains.

9. The emulsion of claim 1, wherein said silver halide grains comprises a core/shell type grain, wherein the silver iodide content of said core is not less than 10 mol % to not more than the maximum solid solubility.

10. The emulsion of claim 1, wherein said oxidizer into said dispersion medium is introduced within 120 minutes before introducing said silver halide seed grains.

11. The emulsion of claim 1, wherein said oxidizer into said dispersion medium is introduced within 60 minutes before introducing said silver halide seed grains.

12. A silver halide photographic emulsion which comprises a dispersion medium and silver halide grains, wherein said silver halide grains are prepared by a process comprising the steps of:

(a) preparing a dispersion medium, wherein said dispersion medium comprises a gelatin solution, (b) introducing an oxidizer into said dispersion medium, wherein said oxidizer is selected from the group consisting of an organic peroxide, a quinone, a peroxy acid salt, an ozone, a hydrogen peroxide and a halogen element; and (c) introducing silver halide seed grains, wherein said silver halide seed grains comprises twinned silver halide grains.

* * * * *